US007062195B2

(12) United States Patent
Kurihara et al.

(10) Patent No.: US 7,062,195 B2
(45) Date of Patent: Jun. 13, 2006

(54) TONER SEAL MEMBER, AND PROCESS CARTRIDGE

(75) Inventors: Satoshi Kurihara, Shizuoka (JP); Kunimasa Kasai, Ibaraki (JP); Teruhiko Sasaki, Shizuoka (JP); Naoki Matsumaru, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 48 days.

(21) Appl. No.: 10/823,699

(22) Filed: Apr. 14, 2004

(65) Prior Publication Data

US 2004/0208668 A1 Oct. 21, 2004

(30) Foreign Application Priority Data

Apr. 21, 2003 (JP) ..... 2003-115133

(51) Int. Cl.
*G03G 15/08* (2006.01)

(52) U.S. Cl. ..... 399/102; 399/103

(58) Field of Classification Search ..... 399/102, 399/103

See application file for complete search history.

(56) References Cited

U.S. PATENT DOCUMENTS

| | | | | |
|---|---|---|---|---|
| 5,689,772 | A | 11/1997 | Fujiwara et al. | 399/106 |
| 5,705,447 | A * | 1/1998 | Kubo | 442/334 |
| 5,768,660 | A | 6/1998 | Kurihara et al. | 399/111 |
| 5,870,654 | A | 2/1999 | Sato et al. | 399/109 |
| 5,920,753 | A | 7/1999 | Sasaki et al. | 399/111 |
| 6,137,971 | A | 10/2000 | Sasaki et al. | 399/106 |
| 6,137,973 | A | 10/2000 | Nishiuwatoko et al. | 399/111 |
| 6,141,508 | A | 10/2000 | Sasaki et al. | 399/27 |
| 6,169,867 | B1 | 1/2001 | Kurihara | 399/123 |
| 6,178,302 | B1 | 1/2001 | Nagashima et al. | 399/106 |
| 6,183,075 | B1 | 2/2001 | Sasaki | 347/86 |
| 6,327,448 | B1 | 12/2001 | Sasaki | 399/111 |
| 6,714,749 | B1 | 3/2004 | Sato et al. | 399/102 |
| 6,901,228 | B1 * | 5/2005 | Kamimura et al. | 399/103 |
| 2002/0044794 | A1 | 4/2002 | Nishiuwatoko et al. | 399/167 |
| 2003/0152395 | A1 | 8/2003 | Kurihara | 399/27 |
| 2003/0235429 | A1 | 12/2003 | Sato et al. | 399/111 |
| 2004/0013446 | A1 | 1/2004 | Morioka et al. | 399/111 |
| 2004/0028429 | A1 | 2/2004 | Matsumaru | 399/276 |

FOREIGN PATENT DOCUMENTS

| | | |
|---|---|---|
| JP | 2001-290405 | 10/2001 |

* cited by examiner

*Primary Examiner*—Arthur T. Grimley
*Assistant Examiner*—Laura K. Roth
(74) *Attorney, Agent, or Firm*—Fitzpatrick, Cella, Harper & Scinto

(57) ABSTRACT

A toner seal member which is maintainable in contact with a rotating member to seal a toner. The toner seal member has a non-woven fabric sheet on a support layer formed of an elastic member, and the non-woven fabric sheet has a fiber diameter of from 2 μm to 10 μm. This toner seal member can prevent fine toner from leaking via a photosensitive drum surface and can also prevent coarse powder toner from adhering to the photosensitive drum surface, and has sufficient toner sealing properties without damaging the functions of the photosensitive drum and image-forming performance.

6 Claims, 4 Drawing Sheets

TONER SEAL MEMBER, AND PROCESS CARTRIDGE

BACKGROUND OF THE INVENTION

1. Field of the Invention

This invention relates to a toner seal member for preventing leakage of fine powder, and a process cartridge detachably mountable to the main body of an image forming apparatus.

2. Related Background Art

Conventionally, in electrophotographic image forming apparatus, an image bearing member (hereinafter "photosensitive drum") charged uniformly electrostatically by a charging means is selectively exposed to light to form an electrostatic latent image on the photosensitive drum surface. Then, a developer (toner) is fed from a developer carrying member developing sleeve to the photosensitive drum to make the latent image visible, and thereafter the toner image formed is transferred to a recording medium, and is further fixed by the action of heat and pressure.

Transfer residual toner not transferred and having remained on the photosensitive drum is scraped off the photosensitive drum by a cleaning means, and the transfer residual toner is collected in a waste toner holder by means of a scoop sheet which is provided upstream as seen from the direction of rotation of the photosensitive drum, without scattering inside the image forming apparatus main body.

Here, as the cleaning means, a method is widely used in which a cleaning blade made of an elastic material, such as rubber that is provided in contact with the photosensitive member surface, is attached to a cleaning frame member.

At both ends of the cleaning frame member, toner seal members are attached in order to prevent the toner from leaking through gaps between the cleaning blade and the cleaning frame member and between the photosensitive drum and the cleaning frame member.

Toner seal members are also attached on the side of a development frame member, corresponding to both lengthwise ends of the developing sleeve, and gaps between the developing sleeve and the development frame member are sealed to prevent the toner from scattering or leaking therethrough.

In conventional toner seal members, used are (a) a layered structure in which a high-density polyethylene is stuck to a part of an elastic member made of foamed polyurethane, (b) a layered structure in which an elastic member made of foamed polyurethane or wool or synthetic-fiber felt is bonded to a felt layer of fluorine fiber, and (c) a layered structure in which an elastic member made of foamed polyurethane or wool or synthetic-fiber felt is bonded to a pile fabric of fluorine fiber (see, e.g., Japanese Patent Application Laid-Open No. 2001-290405.).

SUMMARY OF THE INVENTION

The present invention is designed to improve these conventional toner seal members, and aims as an object thereof to provide a toner seal member which can prevent fine toner from leaking via the photosensitive drum surface coming into contact with fine powder in the cleaning frame member and also prevent toner coarse powder from adhering to the photosensitive drum surface, and has sufficient toner sealing properties without damaging the functions of the photosensitive drum and performances concerned with image formation.

Another object of the present invention is to provide a process cartridge having such a toner seal member.

The present invention provides a toner seal member which is to be kept in contact with a rotating member to seal a toner, wherein the toner seal member has a non-woven fabric sheet on a support layer formed of an elastic member, the non-woven fabric sheet having a fiber diameter of from 2 μm to 10 μm.

The present invention also provides a process cartridge detachably mountable to the main body of an electrophotographic image forming apparatus, the process cartridge comprising an image bearing member and a toner seal member kept in contact with the image bearing member to seal a toner, wherein the toner seal member has a non-woven fabric sheet on a support layer formed of an elastic member, the non-woven fabric sheet having a fiber diameter of from 2 μm to 10 μm.

In the toner seal member according to the present invention, the non-woven fabric sheet has the fiber diameter of from 2 μm to 10 μm, and this makes higher the toner collection ability by which the fine-diameter toner having adhered to the photosensitive drum surface can be wiped off without making the toner slip through, and makes it possible to assure the production of stable images over a long period of time.

PREFERRED EMBODIMENTS OF THE INVENTION

The toner seal member according to the present invention makes use of a non-woven fabric sheet having a fiber diameter of from 2 μm to 10 μm. As a fiber of the non-woven fabric sheet used in the present invention, a synthetic fiber of polyester, polyamide or polyethylene may be used. In particular, polyester fiber is preferred.

The non-woven fabric sheet may more preferably have a fiber diameter of from 2 μm to 8 μm in view of toner wipe-off performance. The non-woven fabric sheet may also preferably have a void fraction of from 0.85 to 0.90 in view of the ability to collect the toner wiped off.

Embodiments of the present invention are described below with reference to the accompanying drawings. In the following description, the lengthwise direction of a process cartridge refers to the direction that crosses (substantially at right angles) the direction in which the process cartridge is mounted to or detached from the main body of an image forming apparatus from the side.

Figure 1:
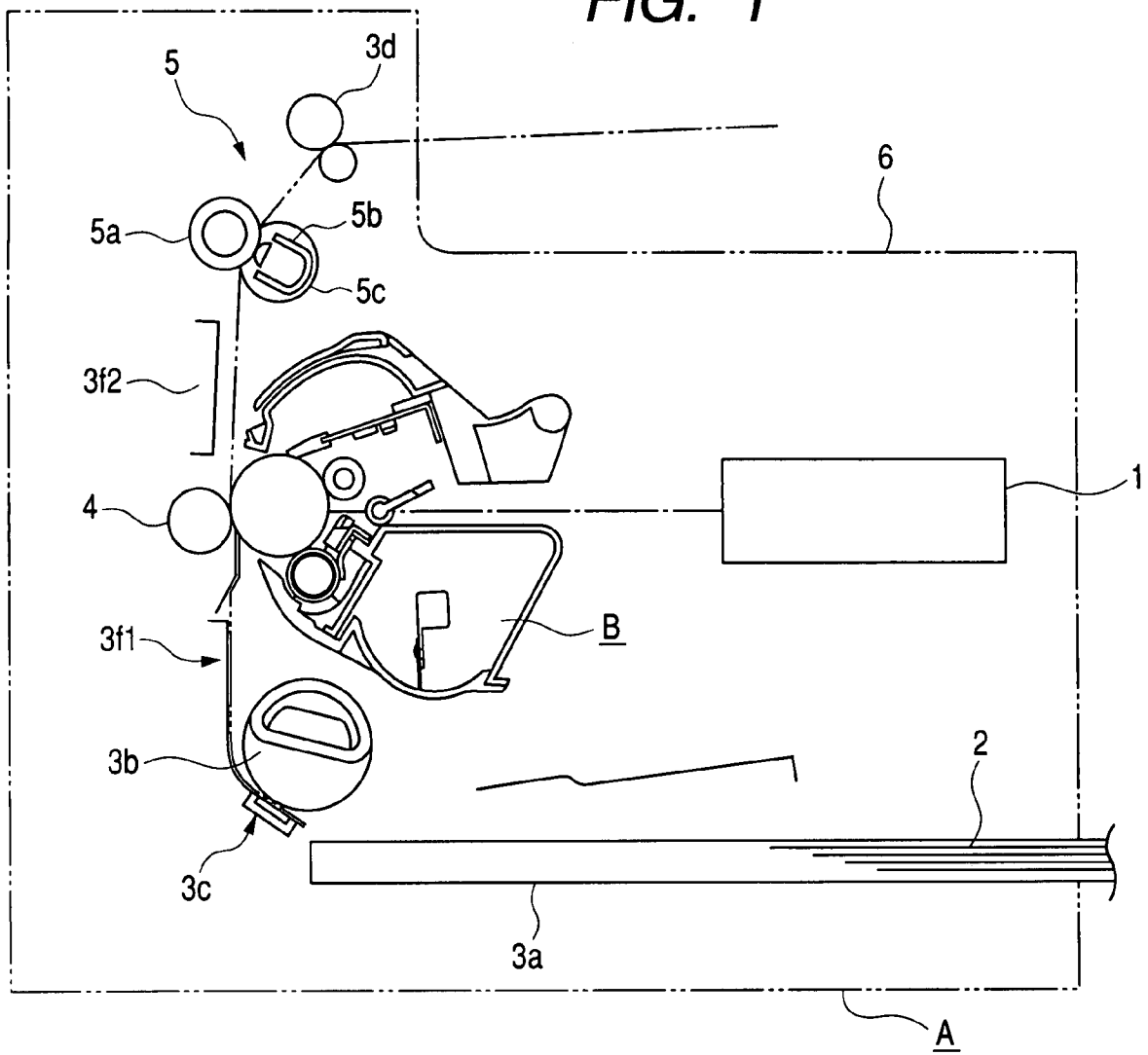
FIG. 1 is a schematic view of an image forming apparatus according to the present invention.
Figure 2:
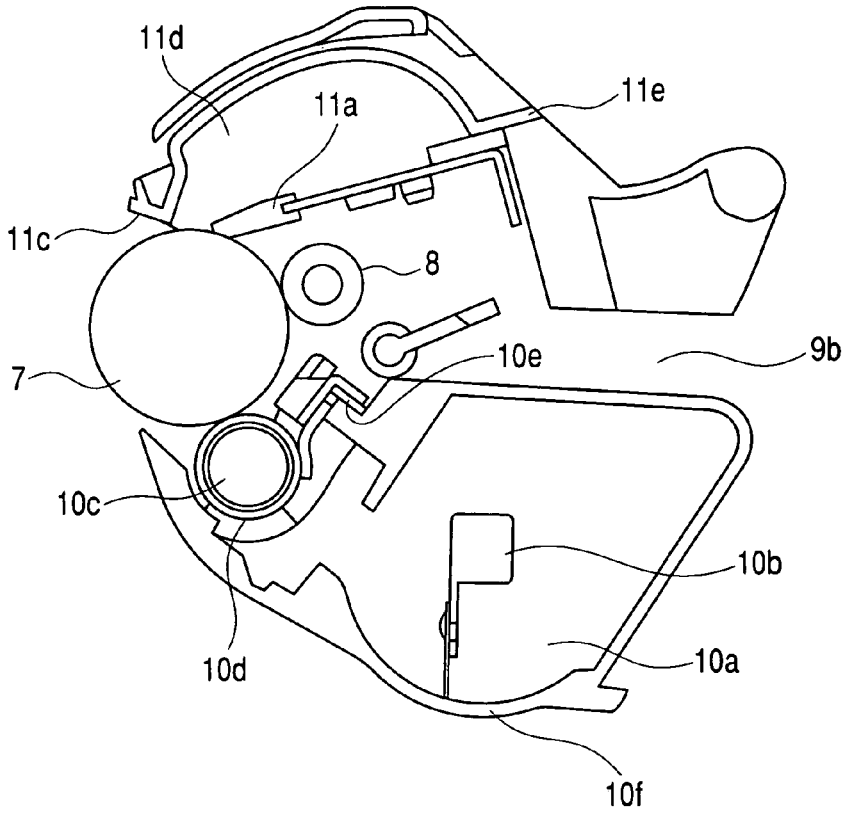
FIG. 2 is a schematic view of a process cartridge according to the present invention.

First, a process cartridge and an electrophotographic image forming apparatus to which the former is detachably mountable are described with reference to FIGS. 1 and 2. FIG. 1 is a diagrammatic view of the construction of an electrophotographic image forming apparatus to which a process cartridge has been mounted. FIG. 2 is a diagrammatic view of the construction of the process cartridge. Here, as the order of description, the whole construction of the electrophotographic image forming apparatus and the process cartridge used therein are first described and then the toner seal member according to the present invention is described in detail.

(Whole Construction)

This electrophotographic image forming apparatus (a laser beam printer, hereinafter "image forming apparatus"), A, is constructed in the following way: As shown in FIG. 1, a drum-shaped electrophotographic photosensitive member (image bearing member, hereinafter "photosensitive drum") 7 is irradiated with information light based on image information, emitted from an optical system 1 as an optical means, to form an electrostatic latent image on the photosensitive drum 7, and this electrostatic latent image is developed with a developer (hereinafter "toner") to form a toner image. Then, in synchronization with the formation of the toner image, a recording medium (such as a recording paper, an OHP sheet or a cloth) 2 is sheet by sheet separately fed from a cassette 3*a* by means of a pick-up roller 3*b* and a pressure contact member 3*c* provided in pressure contact therewith, and is further fed along a transfer guide 3*f*1. Then, the toner image formed on the photosensitive drum 7 of a process cartridge B is transferred to the recording medium 2 by applying a voltage to a transfer roller 4 serving as a transfer means, and this recording medium 2 is transported to a fixing means 5 along a transfer guide 3*f*2. This fixing means 5 consists basically of a drive roller 5*a*, and a fixing rotary member 5*c* constituted of a cylindrical sheet provided internally with a heater 5*b* and supported rotatably, and fixes the transferred toner image by applying heat and pressure to the recording medium 2 being passed there. Then, this recording medium 2 is transported by means of a delivery roller 3*d*, and is put out to a delivery section 6 through a reverse transport path. Incidentally, in this embodiment, the transport means is constituted of the pick-up roller 3*b*, the pressure contact member 3*c*, the delivery roller 3*d* and so forth.

(Construction of Process Cartridge)

Meanwhile, the process cartridge B has an electrophotographic photosensitive member (photosensitive drum) and at least one process means. Here, the process means includes, e.g., a charging means which charges the electrophotographic photosensitive member electrostatically, a developing means which develops the electrostatic latent image formed on the electrophotographic photosensitive member, and a cleaning means for cleaning the toner remaining on the electrophotographic photosensitive member. The process cartridge B of the present embodiment is constructed in the following way: As shown in FIG. 2, a photosensitive drum 7, which is an electrophotographic photosensitive member having a photosensitive layer, is rotated, where the surface of the photosensitive drum 7 is uniformly electrostatically charged by applying a voltage to a charging means comprising a charging roller 8, and is exposed through an exposure opening 9*b* to information light (optical image) based on image information, emitted from the optical system 1, to form the electrostatic latent image on the photosensitive drum 7 surface. This electrostatic latent image is developed by means of the developing means.

The developing means sends out a toner held in a toner container section 10*a*, by means of a rotatable feeding member 10*b* which is a toner-feeding member. Then, a developing sleeve 10*d*, which is a developing rotating member (developer carrying member) provided therein with a stationary magnet 10*c*, is rotated, and also a toner layer to which triboelectric charges have been imparted is formed on the developing sleeve 10*d* by means of a developer blade 10*e*. The toner of this toner layer is moved to the photosensitive drum 7 in accordance with the electrostatic latent image to form a toner image so as to be rendered visible.

Then, after the toner image has been transferred to the recording medium 2 by applying to the transfer roller 4 a voltage with a polarity reverse to that of the toner image, the toner having remained on the photosensitive drum 7 is scraped off by means of a cleaning blade 11*a* and also scooped out by a scoop sheet 11*c* so that the toner remaining on the photosensitive drum 7 can be removed by means of a cleaning assembly in which the removed toner is gathered in a waste-toner holder section 11*d*.

The process cartridge B shown in this embodiment consists basically of a cleaning frame member 11*e* which supports the photosensitive drum 7 rotatably and is incorporated with the cleaning blade 11*a* and the charging roller 8, and a toner development frame member 10*f* which is incorporated with a developing assembly and a toner container section 10*a*. Then, the toner development frame member 10*f* is rotatably supported with respect to the cleaning frame member 11*e* in such a way that the developing sleeve 10*d* of the developing assembly can face the photosensitive drum 7 in parallel and leaving a stated space between them. Spacers (not shown) which keep the space between the developing sleeve 10*d* and the photosensitive drum 7 are disposed at both end portions of the developing sleeve 10*d*.

Figure 3:
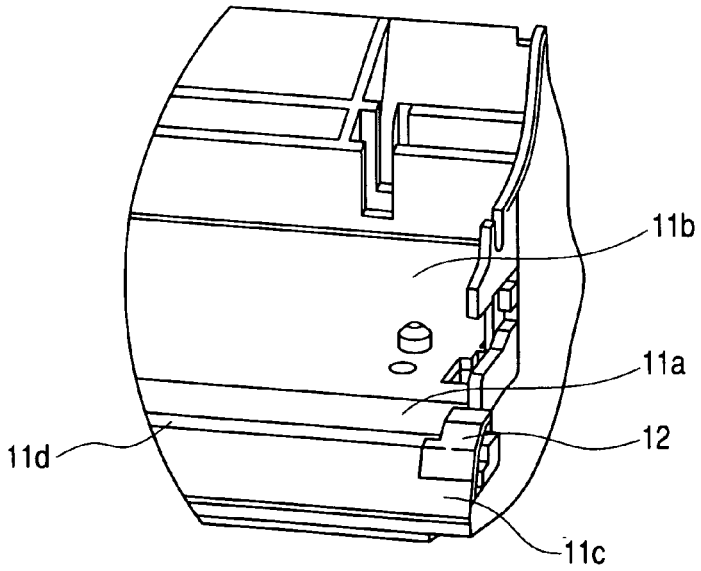
FIG. 3 is a schematic view of a cleaning unit according to the present invention.

Next, the cleaning assembly used in the present invention is described in detail with reference to FIG. 3. The cleaning assembly is constituted of i) the cleaning blade 11*a*, which is made of urethane rubber and is supported with a sheet metal 11*b* and in this state is kept in contact with the photosensitive drum 7 surface in what is called the counter direction thereto, ii) the waste-toner holder section 11*d*, which receives the toner scraped off the photosensitive drum 7 surface by the cleaning blade 11*a*, and iii) a toner seal member 12 which is attached to each end portion of the waste-toner holder section 11*d*, positioned at each end portion bearing surface in the lengthwise direction of the cleaning blade 11*a*, and one face of which is kept in pressure contact with the surface of the photosensitive drum 7 to prevent the toner from leaking and scattering from the waste-toner holder section 11*d*.

As an example of the non-woven fabric sheet, a case is described in which a polyester nonwoven fabric is used.

Figure 4:
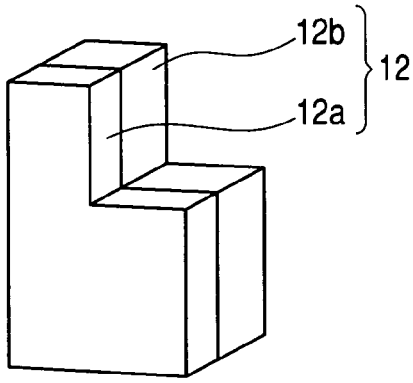
FIG. 4 is a detailed view of the toner seal member.

A detailed view of the toner seal member 12 is shown in FIG. 4. An L-shaped toner seal member 12 has an elastic member 12*b* made of foamed polyurethane, wool or synthetic-fiber felt or the like, to the surface of which a sheetlike member 12*a*, formed of a polyester nonwoven fabric of from 0.1 mm to 4 mm in thickness, is bonded with, e.g., a double-side pressure-sensitive tape or a hot-melt adhesive. Then, this toner seal member 12 is stuck with, e.g., a double-side pressure-sensitive tape to each end portion of the waste-toner holder section 11*d*, and is also kept in pressure contact with the photosensitive drum 7 in such a way that its surface extends along the curvature of the surface of the photosensitive drum 7 by virtue of the elasticity of the elastic member 12*b*. The toner having come from the atmosphere to adhere to the end portions of the photosensitive drum in its lengthwise direction is wiped off by the toner seal member, and the toner is wiped off into voids formed in entangled fibers is collected.

Performance evaluation is described below in detail in respect of the polyester non-woven fabric sheet (manufacturer: Toray Industries, Inc.; Wiping Cloth SILRISM, type name: YNS330N) used in the present invention. Here, results obtained in comparison with a TEFLON (Du Pont's polyfluoroethylene polymer) felt sheet having been used in conventional toner seal members are also shown. A comparison was also made of the fiber thickness (i.e., non-woven fabric sheet thickness) (t), the diameter (D), the basis weight (G), the specific gravity ®) and the void fraction (k) of the respective materials used in the evaluation. Results are shown in Table 1. Here, the void fraction is defined to be:

$$\kappa=1-[G/(\rho\times t\times 10^3)],$$

and is given as a numerical value which represents a porosity of entangled fibers.

TABLE 1

| Sheet material | Fiber thickness (t) (mm) | Fiber diameter (D) (μm) | Basis weight (G) (g/m$^2$) | Specific gravity (ρ) | Void fraction (κ) |
|---|---|---|---|---|---|
| Polyester nonwoven fabric: | 1.4 | 2 to 10 | 230 | 1.38 | 0.88 |
| TEFLON felt: | 1.4 | 21 | 650 | 2.3 | 0.80 |

Figure 5:
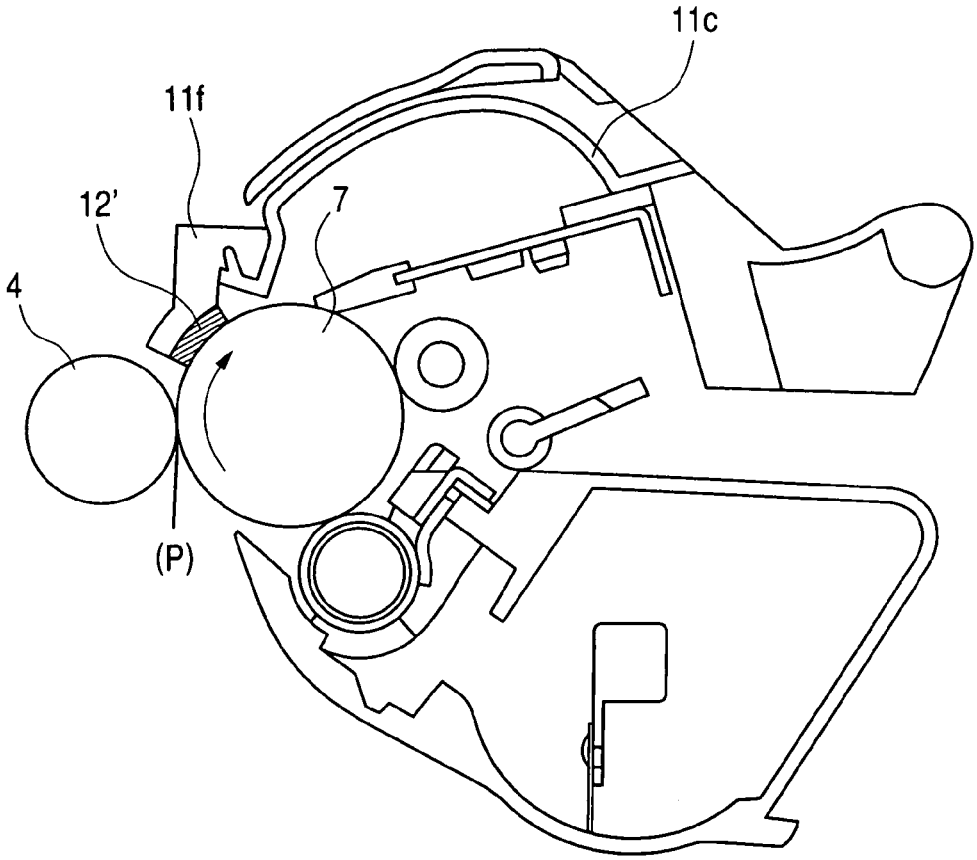
FIG. 5 is a schematic view showing the evaluation of performance of the toner seal member.

How to make an evaluation is described below with reference to FIG. 5.

Figure 6:
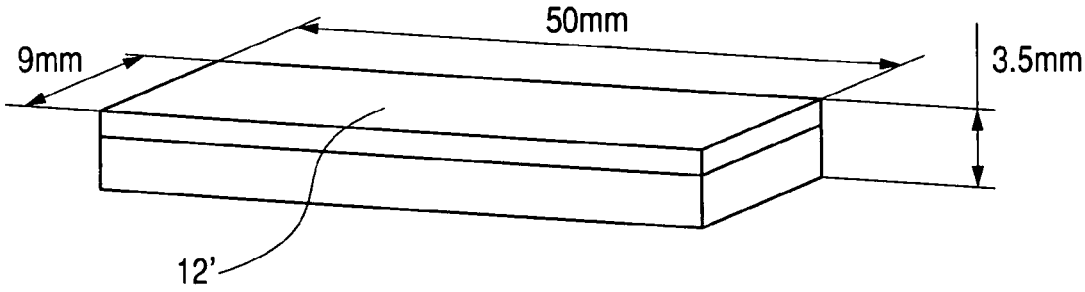
FIG. 6 is a diagrammatic view of a toner seal member used in the evaluation of performance.

As described previously, in this embodiment, the toner seal member 12 is provided at each end portion bearing surface in the lengthwise direction of the waste-toner holder section 11*d*. In this evaluation, however, what is intended is the evaluation of materials, and hence three seal members 12' each having the size shown in FIG. 6 are prepared, and a seal-member-sticking bearing member 11*f* is provided over the lengthwise whole area of the cleaning frame member 11*e*, where the seal members 12' are fastened with a double-side pressure-sensitive tape to the sticking bearing surface 11*f*. The sticking bearing member 11*f* is provided on the side that is downstream, as viewed from the rotational direction of the photosensitive drum 7, to the position (P) at which the transfer roller 4 of the image forming apparatus main body and the photosensitive drum 7 are kept in contact with each other and on the side that is upstream to the cleaning blade 11*a*. The process cartridge is inserted to the image forming apparatus main body and is so constructed that the toner remaining on the photosensitive drum 7 after the transfer to the recording medium can be wiped off and collected. The seal-member-sticking bearing member 11*f* is also so made up as to be detachable from the waste-toner holder section 11*d*. Here, as toner wipe-off ability, the weight of toner having adhered to the seal members 12' is measured to make the evaluation.

Figure 7:
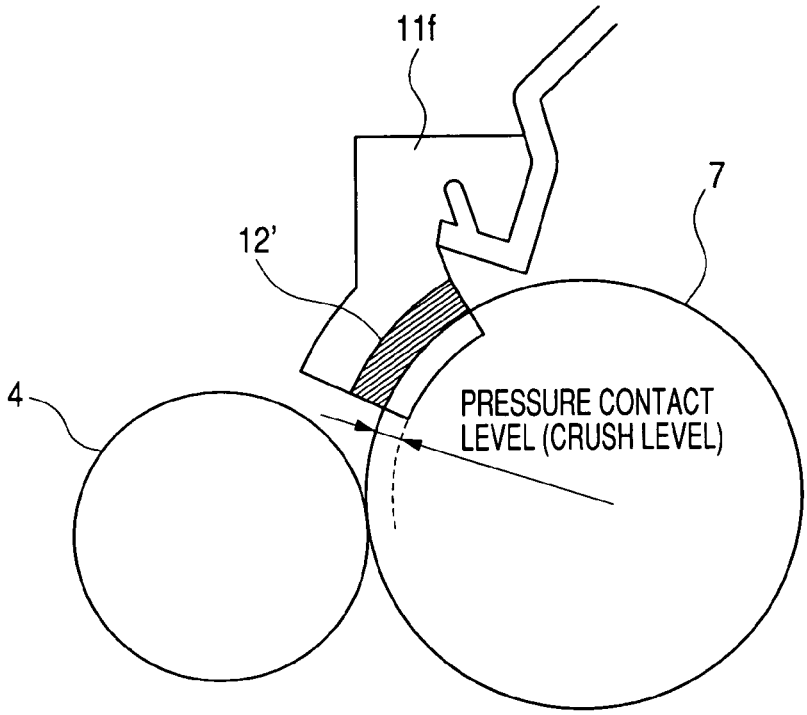
FIG. 7 is a schematic view showing the evaluation of performance of the toner seal member.

The positional relationship between the photosensitive drum 7, the seal member 12' and the sticking bearing surface 11*f* is shown in FIG. 7. In this evaluation test, the sticking bearing member 11*f* is made to have a shape arced concentrically to the photosensitive drum 7, and the level of pressure contact with the photosensitive drum (i.e., crush level) of the seal member 12' is set to 2 mm, to make an evaluation.

In the evaluation, the main body and process cartridge of an image forming apparatus laser beam printer (manufacturer: Hewlett-Packard Co.; trade name: hp LASERJET Series/Series 1200) were used.

The evaluation was also made setting as parameters the fiber diameter D and void fraction k of the polyester non-woven fabric. The fiber diameter was measured by observing the fiber thickness on a microscope (magnifications: 500) and expressed as an arithmetic mean of the thickness of twenty fibers taken at random.

The results of evaluation is shown in Table 2 below.

TABLE 2

| | Test I | Test II | Test III | Test IV | Comparative test |
|---|---|---|---|---|---|
| Material: | Polyester | Polyester | Polyester | Polyester | TEFLON |
| Fiber diameter D: (μm) | 2 | 5 | 8 | 10 | 20 |
| Void fraction κ: | 0.90 | 0.88 | 0.86 | 0.85 | 0.80 |
| Toner wipe-off performance: (g) | 8 | 10 | 8 | 6 | 2 |

What can be seen from the results of evaluation is that the polyester nonwoven fabric has toner wipe-off performance superior to the conventional TEFLON felt. This is due to the fact that the polyester nonwoven fabric has a smaller fiber diameter than the TEFLON felt.

In order that the fine-diameter toner having adhered to the photosensitive drum surface is wiped off without making the toner slip through, it is considered advantageous for the fiber diameter to be smaller. Also, when the wiped off toner is collected into the voids of fibers, it is considered advantageous for the void fraction to be larger. In this respect as well, the polyester non-woven fabric is more advantageous than the TEFLON felt with regard to the toner collection ability.

It is considered that, the smaller the fiber diameter and the larger the void fraction, the higher the toner wipe-off ability. It, however, is considered that, if the fiber diameter is less than 2 μm under conditions of actual use, the fibers may become so weak in stiffness as to be disadvantageous in respect of durability. It is also considered that, if the fiber diameter is more than 8 μm, the toner seal member may make the toner slip through in a high percentage.

In the process cartridge shown in the above embodiment, the electrophotographic photosensitive member is by no means limited to the photosensitive drum, and may also be, e.g., the following: As the photosensitive member, a photoconductor may be used. As the photoconductor, an amorphous silicon photoconductor, an amorphous selenium photoconductor, a zinc oxide photoconductor, a titanium oxide photoconductor and an organic photoconductor (OPC) may be used, for example. As the shape in which the photosensitive member is mounted, it may be in the shape of a drum or a belt. In the case of, e.g., the drum type photosensitive member, a cylinder made of an aluminum alloy and provided on the surface thereof with the photoconductor by vacuum deposition or coating may be used.

As developing methods as well, it is possible to use various developing methods, such as two-component magnetic brush development, cascade development, touchdown development and cloud development which are known in the art.

In constructing the charging means as well, what is called contact charging is used in the above embodiment. As other constructions, a construction may of course be employed in which metallic shields of aluminum or the like are provided on the three sides around a tungsten wire and a high voltage is applied to the tungsten wire, where the positive or negative ions thereby produced are made to move to the surface of the photosensitive drum to charge the drum surface uniformly.

Incidentally, as the charging means, besides the above roller type, usable are means of a blade type (charging blade), a pad type, a block type, a rod type and a wire type.

As the cleaning method for removing the toner remaining on the photosensitive drum, the cleaning means may be made up using a blade, a fur brush, a magnetic brush or the like.

The process cartridge described above is one having, e.g., the electrophotographic photosensitive member and at least one process means. Accordingly, as embodiments of the process cartridge, it may include, in addition to the process cartridge in the above embodiment, e.g., one in which the electrophotographic photosensitive member and the developing means are integrally set as a cartridge so as to be detachably mountable to the apparatus main body; and also one in which the electrophotographic photosensitive member, the developing means and any of the charging means and the cleaning means are integrally set in combination as a cartridge so as to be detachably mountable to the apparatus main body.

That is, the process cartridge described above refers to one in which at least the developing means and the electrophotographic photosensitive member are integrally set as a cartridge so as to be detachably mountable to the image forming apparatus main body. In addition, this process cartridge is detachably mountable to the apparatus main body by users themselves. Accordingly, the maintenance service of the apparatus main body can be performed by users themselves.

Further, in the embodiment described above, a laser beam printer is exemplified as the electrophotographic image forming apparatus. The present invention is by no means limited thereto. It is of course possible to use electrophotographic image forming apparatus as exemplified by an electrophotographic copying machine, an electrophotographic printer (such as an LED printer), a facsimile machine and a word processor, or a composite machine of any of these (multi-function printer).

What is claimed is:

1. A toner seal member maintainable in contact with a rotating member to seal a toner, wherein said toner seal member has a non-woven fabric sheet on a support layer formed of an elastic member, said non-woven fabric sheet having a fiber diameter of from 2 μm to 10 μm, and having a void fraction of from 0.85 to 0.90.

2. The toner seal member according to claim 1, wherein said non-woven fabric sheet has a fiber diameter of from 2 μm to 8 μm.

3. The toner seal member according to claim 1, wherein said non-woven fabric sheet comprises a polyester non-woven fabric.

4. A process cartridge detachably mountable to the main body of an electrophotographic image forming apparatus, said process cartridge comprising:

an image bearing member; and a toner seal member kept in contact with said image bearing member to seal a toner, wherein said toner seal member has a non-woven fabric sheet on a support layer formed of an elastic member, said non-woven fabric sheet having a fiber diameter of from 2 μm to 10 μm, and having a void fraction of from 0.85 to 0.90.

5. The process cartridge according to claim 4, wherein said non-woven fabric sheet has a fiber diameter of from 2 μm to 8 μm.

6. The process cartridge according to claim 5, wherein said non-woven fabric sheet comprises a polyester non-woven fabric.

* * * * *